US011205371B2

(12) United States Patent
Sun et al.

(10) Patent No.: US 11,205,371 B2
(45) Date of Patent: Dec. 21, 2021

(54) GATE DRIVING CIRCUIT, DRIVING METHOD THEREOF, AND DISPLAY APPARATUS

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Jing Sun, Beijing (CN); Miao Zhang, Beijing (CN); Jinliang Liu, Beijing (CN); Huanyu Li, Beijing (CN)

(73) Assignees: HEFEI XINSHENG OPTOELECTRONICS TECHNOLOGY CO., LTD, Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 462 days.

(21) Appl. No.: 16/331,742

(22) PCT Filed: Apr. 25, 2018

(86) PCT No.: PCT/CN2018/084337
§ 371 (c)(1),
(2) Date: Mar. 8, 2019

(87) PCT Pub. No.: WO2019/140803
PCT Pub. Date: Jul. 25, 2019

(65) Prior Publication Data

US 2021/0335194 A1 Oct. 28, 2021

(30) Foreign Application Priority Data

Jan. 22, 2018 (CN) ..... 201810059586.7

(51) Int. Cl.
*G09G 3/36* (2006.01)
*G09G 3/20* (2006.01)

(52) U.S. Cl.
CPC ... *G09G 3/2092* (2013.01); *G09G 2300/0426* (2013.01); *G09G 2310/0286* (2013.01); *G09G 2310/061* (2013.01); *G09G 2310/08* (2013.01)

(58) Field of Classification Search
None
See application file for complete search history.

(56) References Cited

U.S. PATENT DOCUMENTS 9,117,418 B2 8/2015 Zhang et al.
9,543,040 B2 1/2017 Qing et al.
(Continued)

FOREIGN PATENT DOCUMENTS

CN 102654986 A 9/2012
CN 102708778 A 10/2012
(Continued)

OTHER PUBLICATIONS

Office Action dated May 17, 2019, issued in counterpart CN application No. 201810059586.7, with English translation. (11 pages).

(Continued)

*Primary Examiner* — Krishna P Neupane
(74) *Attorney, Agent, or Firm* — Westerman, Hattori, Daniels & Adrian, LLP

(57) ABSTRACT

The present disclosure is related to a gate driving circuit. The gate driving circuit may include a first pull-up subcircuit; a second pull-up subcircuit; a first pull-down subcircuit; and a second pull-down subcircuit. The first pull-up subcircuit may be configured to output a high level to the output terminal under control of a first control signal of a first control signal terminal. The second pull-up subcircuit may (Continued)

be configured to output a high level to the output terminal under control of a second control signal of a second control signal terminal. The first pull-down subcircuit may be configured to pull down a level of the output terminal under control of the first control signal. The second pull-down subcircuit may be configured to pull down the level of the output terminal under control of the second control signal.

16 Claims, 7 Drawing Sheets

(56) References Cited

U.S. PATENT DOCUMENTS

| | | | | |
|---|---|---|---|---|
| 9,734,918 | B2 | 8/2017 | Oi et al. | |
| 2014/0086379 | A1 | 3/2014 | Ma et al. | |
| 2014/0355732 | A1 | 12/2014 | Lin et al. | |
| 2017/0178581 | A1* | 6/2017 | Li | G09G 3/3655 |
| 2017/0278450 | A1* | 9/2017 | Ma | G09G 3/3648 |

FOREIGN PATENT DOCUMENTS

| | | | |
|---|---|---|---|
| CN | 102968950 | A | 3/2013 |
| CN | 103400601 | A | 11/2013 |
| CN | 103617775 | A | 3/2014 |
| CN | 103778896 | A | 5/2014 |
| CN | 104282285 | A | 1/2015 |
| CN | 104700812 | A | 6/2015 |
| CN | 104966506 | A | 10/2015 |
| CN | 106157867 | A | 11/2016 |
| WO | 2017/113984 | A1 | 7/2017 |

OTHER PUBLICATIONS

International Search Report dated Sep. 29, 2018, issued in counterpart application No. PCT/CN2018/084337. (9 pages).

* cited by examiner

Related Art

Related Art

GATE DRIVING CIRCUIT, DRIVING METHOD THEREOF, AND DISPLAY APPARATUS

CROSS-REFERENCE TO RELATED APPLICATIONS

This application claims benefit of the filing date of Chinese Patent Application No. 201810059586.7 filed on Jan. 22, 2018, the disclosure of which is hereby incorporated in its entirety by reference.

TECHNICAL FIELD

This invention relates to a gate driving circuit, a driving method thereof and a display apparatus.

BACKGROUND

With popularity of liquid crystal display apparatuses, they have been widely used in electronic devices such as televisions, mobile phones, computers, and the like. In an existing liquid crystal display apparatus, row scanning of the liquid crystal display apparatus is generally achieved using a gate driving circuit to turn on and off thin film transistors (TFT) in the pixel units.

BRIEF SUMMARY

Accordingly, one example of the present disclosure is a gate driving circuit. The gate driving circuit may include a first pull-up subcircuit, a second pull-up subcircuit, a first pull-down subcircuit, and a second pull-down subcircuit. The first pull-up subcircuit may be respectively electrically connected with a first control signal terminal, a pull-up node, a first clock signal terminal, and an output terminal, and the first pull-up subcircuit may be configured to output a high level to the output terminal under control of a first control signal of the first control signal terminal. The second pull-up subcircuit may be respectively electrically connected with a second control signal terminal, the pull-up node, the first clock signal terminal, and the second pull-up subcircuit may be configured to output a high level to the output terminal under control of a second control signal of the second control signal terminal. The first pull-down subcircuit may be electrically connected with the first control signal terminal, a reset signal terminal, a first level terminal and the output terminal, and the first pull-down subcircuit may be configured to pull down a level of the output terminal under control of the first control signal. The second pull-down subcircuit may be respectively electrically connected with the second control signal terminal, the reset signal terminal, the first level terminal, and the output terminal, and the second pull-down subcircuit may be configured to pull down the level of the output terminal under control of the second control signal.

The gate driving circuit may further include an input subcircuit, a reset subcircuit, and a storage subcircuit. The input subcircuit may be respectively electrically connected with an input signal terminal and the pull-up node. The reset subcircuit may be electrically connected with the reset signal terminal, the first level terminal, and the pull-up node respectively, and the reset subcircuit may be configured to pull down a level of the pull-up node under control of the reset signal. The storage subcircuit may be respectively electrically connected with the pull-up node and the output terminal. The first control signal and the second control signal may be signals of the same-frequency with inverse phases.

The input subcircuit may include a first transistor. A gate electrode and a first electrode of the first transistor may be electrically connected with the input signal terminal, and a second electrode of the first transistor may be electrically connected with the pull-up node.

The first pull-up subcircuit may include a second transistor and a third transistor. A gate electrode of the second transistor may be electrically connected with the first control signal terminal, a first electrode of the second transistor may be electrically connected with the pull-up node, and a second electrode of the second transistor may be electrically connected with a gate electrode of the third transistor. A first electrode of the third transistor may be electrically connected with the first clock signal terminal, and a second electrode of the third transistor may be electrically connected with the output terminal.

The second pull-up subcircuit may include a fourth transistor and a fifth transistor. A gate electrode of the fourth transistor may be electrically connected with the second control signal terminal, a first electrode of the fourth transistor may be electrically connected with the pull-up node, and a second electrode of the fourth transistor may be electrically connected with a gate electrode of the fifth transistor. A first electrode of the fifth transistor may be electrically connected with the first clock signal terminal and a second electrode of the fifth transistor may be electrically connected with the output terminal.

The first pull-down subcircuit may include a sixth transistor and a seventh transistor. A gate electrode of the sixth transistor may be electrically connected with the first control signal terminal, a first electrode of the sixth transistor may be electrically connected with the reset signal terminal, and a second electrode of the sixth transistor may be electrically connected with the gate electrode of the seventh transistor. A first electrode of the seventh transistor may be electrically connected with the output terminal and a second electrode of the seventh transistor may be electrically connected with the first level terminal.

The second pull-down subcircuit may include an eighth transistor and a ninth transistor. A gate electrode of the eighth transistor may be electrically connected with the second control signal terminal, a first electrode of the eighth transistor may be electrically connected with the reset signal terminal, and a second electrode of the eighth transistor may be electrically connected with the gate electrode of the ninth transistor. A first electrode of the ninth transistor may be electrically connected with the output terminal, and a second electrode of the ninth transistor may be electrically connected with the first level terminal.

The reset subcircuit may include a tenth transistor. A gate electrode of the tenth transistor may be electrically connected with the reset signal terminal, a first electrode of the tenth transistor may be electrically connected with the pull-up node, and a second electrode of the tenth transistor may be electrically connected with the first level terminal.

The storage subcircuit may include a storage capacitor. A first terminal of the storage capacitor may be electrically connected with the pull-up node, and a second terminal of the storage capacitor may be electrically connected with the output terminal.

The gate driving circuit may further include a pull-down control subcircuit and a third pull-down subcircuit. The pull-down control subcircuit may be respectively electrically connected with the second clock signal terminal and the pull-down node, the pull-up node, and the first level terminal, and the pull-down control subcircuit may be configured to pull up the level of the pull-down node under control of the second clock signal. The second clock signal and the first clock signal inputted to the first clock signal terminal may be signals of the same frequency with inverse phases. The third pull-down subcircuit may be electrically connected with the pull-down node, the first level terminal, the pull-up node, and the output terminal, and the third pull-down subcircuit may be configured to pull down the levels of the pull-up node and the output terminal under control of the pull-down node.

The pull-down control subcircuit may include an eleventh transistor and a twelfth transistor. A gate electrode and a first electrode of the eleventh transistor may be electrically connected with the second clock signal terminal, and a second electrode of the eleventh transistor may be electrically connected with the pull-down node. A gate electrode of the twelfth transistor may be electrically connected with the pull-up node, a first electrode of the twelfth transistor may be electrically connected with the pull-down node, and a second electrode of the twelfth transistor may be electrically connected with the first level terminal.

The third pull-down subcircuit may include a thirteenth transistor and a fourteenth transistor. A gate electrode of the thirteenth transistor may be electrically connected with the pull-down node, a first electrode of the thirteenth transistor may be electrically connected with the pull-up node, and a second electrode of the thirteenth transistor may be electrically connected with the first level terminal. A gate electrode of the fourteenth transistor may be electrically connected with the pull-down node, a first electrode of the fourteenth transistor may be electrically connected with the output terminal, and a second electrode of the fourteenth transistor may be electrically connected with the first level terminal.

Another example of the present disclosure is a driving method of the gate driving circuit according to one embodiment of the present disclosure. The driving method may include a first frame period and a second frame period. In the first frame period, the first control signal terminal may be inputted with a high level and the second control signal terminal may be inputted with a low level. At a first stage of the first frame period, the input signal terminal may be inputted with a high level so that the input subcircuit pulls up the level of the pull-up node under control of the input signal. At a second stage of the first frame period, the first clock signal terminal may be inputted with a high level, and the first pull-up subcircuit may output a high level to the output terminal under control of the first control signal. At a third stage of the first frame period, the reset signal terminal may be inputted with a high level, and the first pull-down subcircuit may pull down the level of the output terminal under control of the first control signal. The reset subcircuit may pull down the level of the pull-up node under control of the reset signal.

In the second frame period, the first control signal terminal may be inputted with a low level, and the second control signal terminal may be inputted with a high level. At a first stage of the second frame period, the input signal terminal may be inputted with a high level, and the input subcircuit may pull up the level of the pull-up node under control of the input signal. At a second stage of the second frame period, the first clock signal terminal may be inputted with a high level, and the second pull-up subcircuit may output a high level to the output terminal under control of the second control signal. At a third stage of the second frame period, the reset signal terminal may be inputted with a high level, the second pull-down subcircuit may pull down the level of the output terminal under control of the second control signal, and the reset subcircuit may pull down the level of the pull-up node under control of the reset signal.

The driving method may further include the following: at the third stage of the first frame period and the third stage of the second frame period, the second clock signal terminal may be inputted with a high level, the pull-down control subcircuit may pull up the level of the pull-down node under control of the second clock signal, and the third pull-down subcircuit may pull down the level of the pull-up node and the level of the output terminal under control of the pull-down node. At a fourth stage of the first frame period and a fourth stage of the second frame period, the pull-down control subcircuit may control the level of the pull-down node under control of the second clock signal and control the third pull-down subcircuit to pull down the levels of the pull-up node and the output terminal.

Another example of the present disclosure is a display apparatus. The display apparatus may include the gate driving circuit according to one embodiment of the present disclosure.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION

Figure 1:
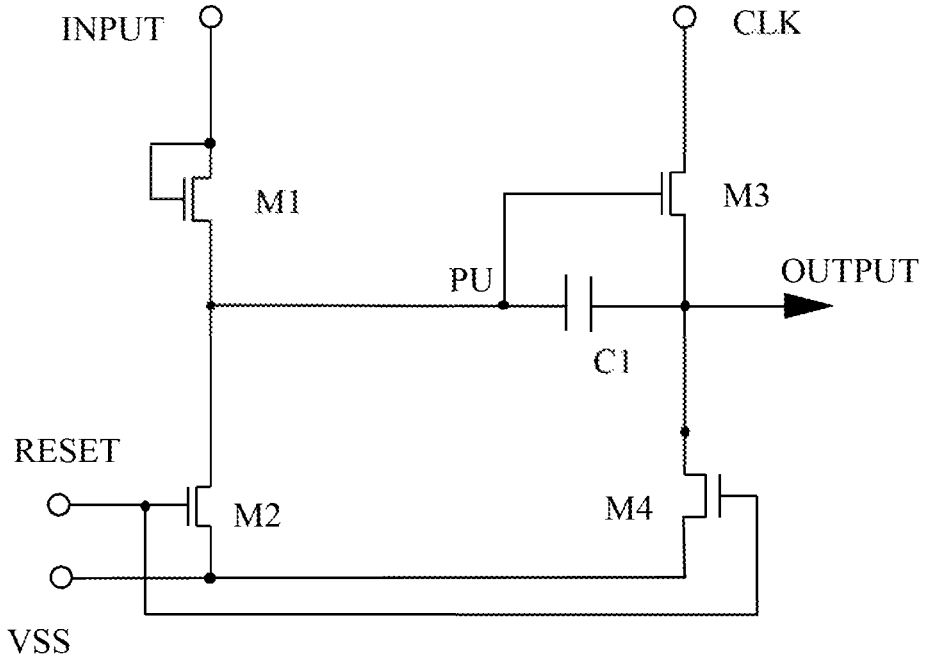
FIG. 1 shows a circuit diagram of a gate driving circuit in the related art.

The present disclosure will be described in further detail with reference to the accompanying drawings and embodiments in order to provide a better understanding by those skilled in the art of the technical solutions of the present disclosure. Throughout the description of the disclosure, reference is made to FIGS. 1-7. When referring to the figures, like structures and elements shown throughout are indicated with like reference numerals. The described embodiments are part of the embodiments of the present disclosure, and are not all embodiments. According to the embodiments of the present disclosure, all other embodiments obtained by persons of ordinary skill in the art without creative efforts, belong to the protection scope of the disclosure.

In the description of the present disclosure, the terms "first" and "second" may be used for illustration purposes only and are not to be construed as indicating or implying relative importance or implied reference to the quantity of indicated technical features. Thus, features defined by the terms "first" and "second" may explicitly or implicitly include one or more of the features. In the description of the present disclosure, the meaning of "plural" is two or more unless otherwise specifically and specifically defined.

In the description of the specification, references made to the term "one embodiment," "some embodiments," and "exemplary embodiments," "example," and "specific example," or "some examples" and the like are intended to refer that specific features and structures, materials or characteristics described in connection with the embodiment or example that are included in at least one embodiment or example of the present disclosure. The schematic expression of the terms does not necessarily refer to the same embodiment or example. Moreover, the specific features, structures, materials or characteristics described may be included in any suitable manner in any one or more embodiments or examples.

Figure 2:
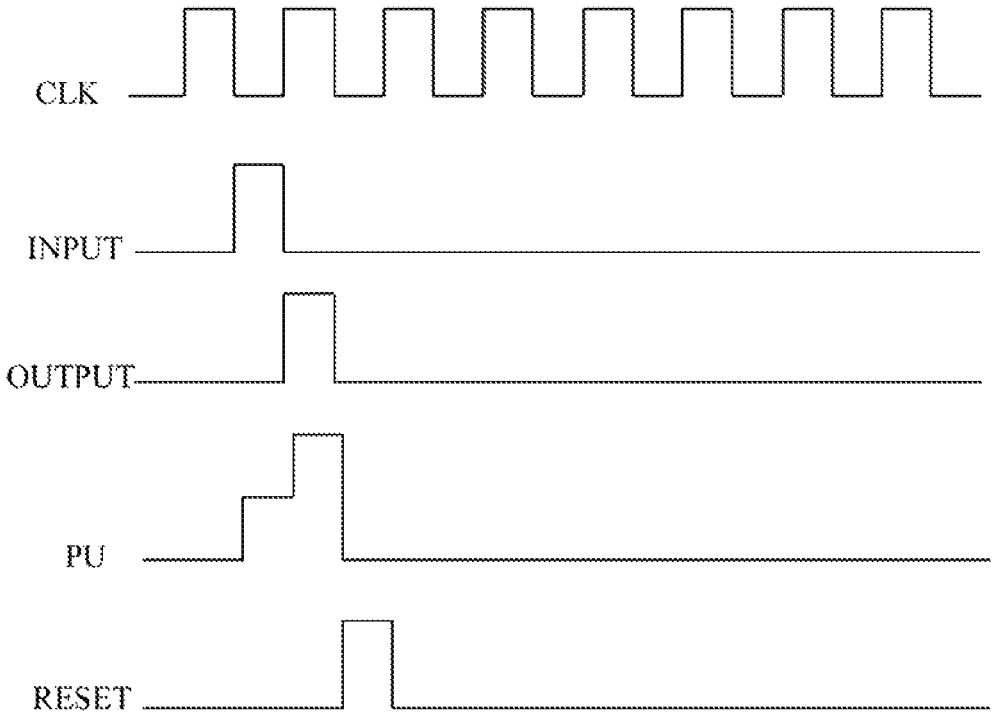
FIG. 2 shows a timing diagram of a gate driving circuit in the related art.

FIG. 1 is a circuit diagram of a gate driving circuit in the related art. FIG. 2 is a timing diagram of a gate driving circuit in the related art. The circuit is used for turning on and off the thin-film transistors in the pixel unit. However, the pull-up TFT (such as M3 in FIG. 1) and the reset TFT (such as M4 in FIG. 1) in the circuit are respectively under action of the signal of a pull-up node PU and the reset signal of a reset signal terminal RESET for a long time so that electric characteristics of the TFTs gradually drift. When a threshold voltage Vth of the TFT is drifted to a certain degree, an output of the output terminal OUTPUT can be remarkably affected, thereby causing various display defects.

Figure 3:
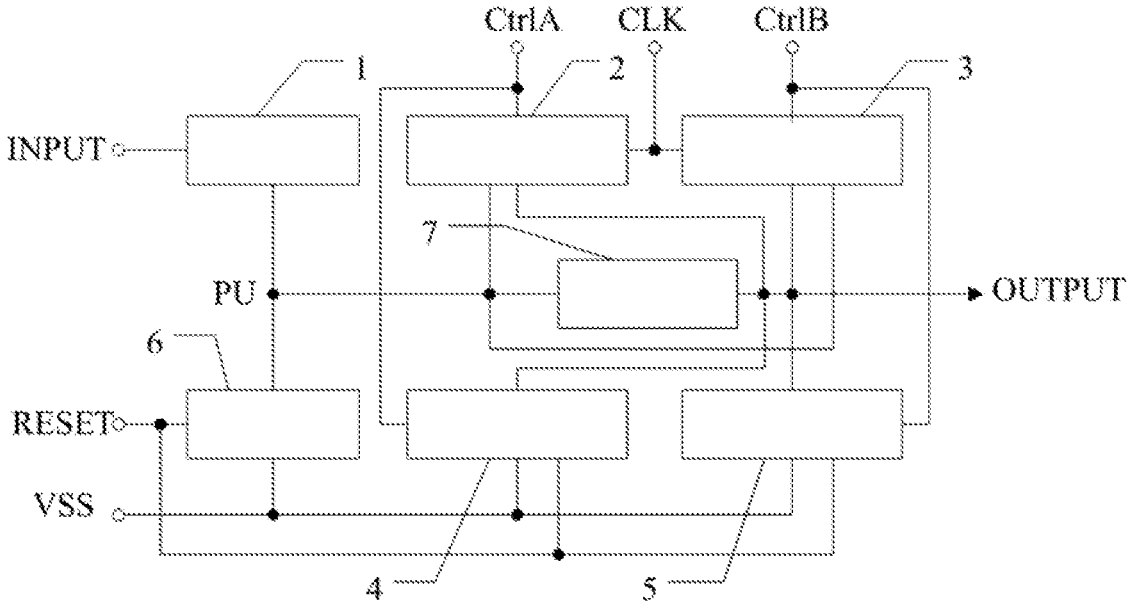
FIG. 3 shows a schematic diagram of a gate driving circuit according to an embodiment of the present disclosure.

FIG. 3 shows a schematic diagram of a gate driving circuit according to an embodiment of the present disclosure.

In one embodiment, the gate driving circuit includes an a first pull-up subcircuit 2, a second pull-up subcircuit 3, a first pull-down subcircuit 4, a second pull-down subcircuit 5.

In another embodiment, the gate driving circuit further includes an input subcircuit 1, a reset subcircuit 6, and a storage subcircuit 7.

The input subcircuit 1 is respectively electrically connected with an input signal terminal INPUT and a pull-up node PU.

The first pull-up subcircuit 2 is respectively electrically connected with a first control signal terminal CtrlA, the pull-up node PU, a first clock signal terminal CLK, and an output terminal OUTPUT. It is used for outputting a high level to the output terminal OUTPUT under control of the first control signal.

The second pull-up subcircuit 3 is respectively electrically connected with the second control signal terminal CtrlB, the pull-up node PU, the first clock signal terminal CLK and the output terminal OUTPUT. It is used for outputting a high level to the output terminal OUTPUT under control of the second control signal.

The first pull-down subcircuit 4 is respectively electrically connected with the first control signal terminal CtrlA, the reset signal terminal RESET, a first level terminal VSS and the output terminal OUTPUT. It is used for pulling down the level of the output terminal OUTPUT under control of the first control signal.

The second pull-down subcircuit 5 is respectively electrically connected with the second control signal terminal CtrlB, the reset signal terminal RESET, a first level terminal VSS and the output terminal OUTPUT. It is used for pulling down the level of the output terminal OUTPUT under control of the second control signal.

The reset subcircuit 6 is respectively electrically connected with a reset signal terminal RESET, the first level terminal VSS and the pull-up node PU. It is used for pulling down the level of the pull-up node PU under control of the reset signal.

The storage subcircuit 7 is respectively electrically connected with the pull-up node PU and the output terminal OUTPUT.

In one embodiment, in a first time period, a first control signal inputted to the first control signal terminal CtrlA controls the first pull-up subcircuit 2 and the first pull-down subcircuit 4 to operate. In a second time period, a second control signal inputted to the second control signal terminal CtrlB controls the second pull-up subcircuit 3 and the second pull-down subcircuit 5 to operate. When the first control signal remains at a high level, the second control signal remains at a low level. When the first control signal remains at a low level, the second control signal remains at a high level.

The duration of the first time period and the duration of the second time period may be equal or not, and they are not limited in the embodiments of the present disclosure. By controlling the level of the first control signal and the level of the second control signal, the first pull-up subcircuit and the second pull-up subcircuit can work alternately. Meanwhile, the first pull-down subcircuit and the second pull-down subcircuit can work alternately. As such, the time when each of the pull-up subcircuits is controlled by the signal of the pull-up node is reduced, and the time when each of the pull-down subcircuits is controlled by the reset signal is also reduced.

In one embodiment, the first control signal and the second control signal are signals of the same frequency with inverse-phase. In one frame of time, when the first control signal is kept at a high level, the second control signal is kept at a low level. When the first control signal is kept at a low level, the second control signal is kept at a high level.

When the first control signal inputted to the first control signal terminal CtrlA is an effective signal, the first pull-up subcircuit 2 and the first pull-down subcircuit 4 can be controlled to operate, and the second pull-up subcircuit 3 and the second pull-down subcircuit 5 do not operate. When the second control signal inputted to the second control signal terminal CtrlB is an effective signal, the second pull-up subcircuit 3 and the second pull-down subcircuit 5 can be controlled to operate, and the first pull-up subcircuit 2 and the first pull-down subcircuit 4 do not operate. As such, the first pull-up subcircuit 2 and the second pull-up subcircuit 3 operate alternately. The first pull-down subcircuit 4 and the second pull-down subcircuit 5 operate alternately. As a result, the time when the signal of the pull-up node PU is applied to the first pull-up subcircuit 2 and the second pull-up subcircuit 3 respectively is reduced to half of original time. Furthermore, the time when the reset signal is applied to the first pull-down subcircuit 4 and the second pull-down subcircuit 5 respectively is reduced to half of the original time.

Figure 4:
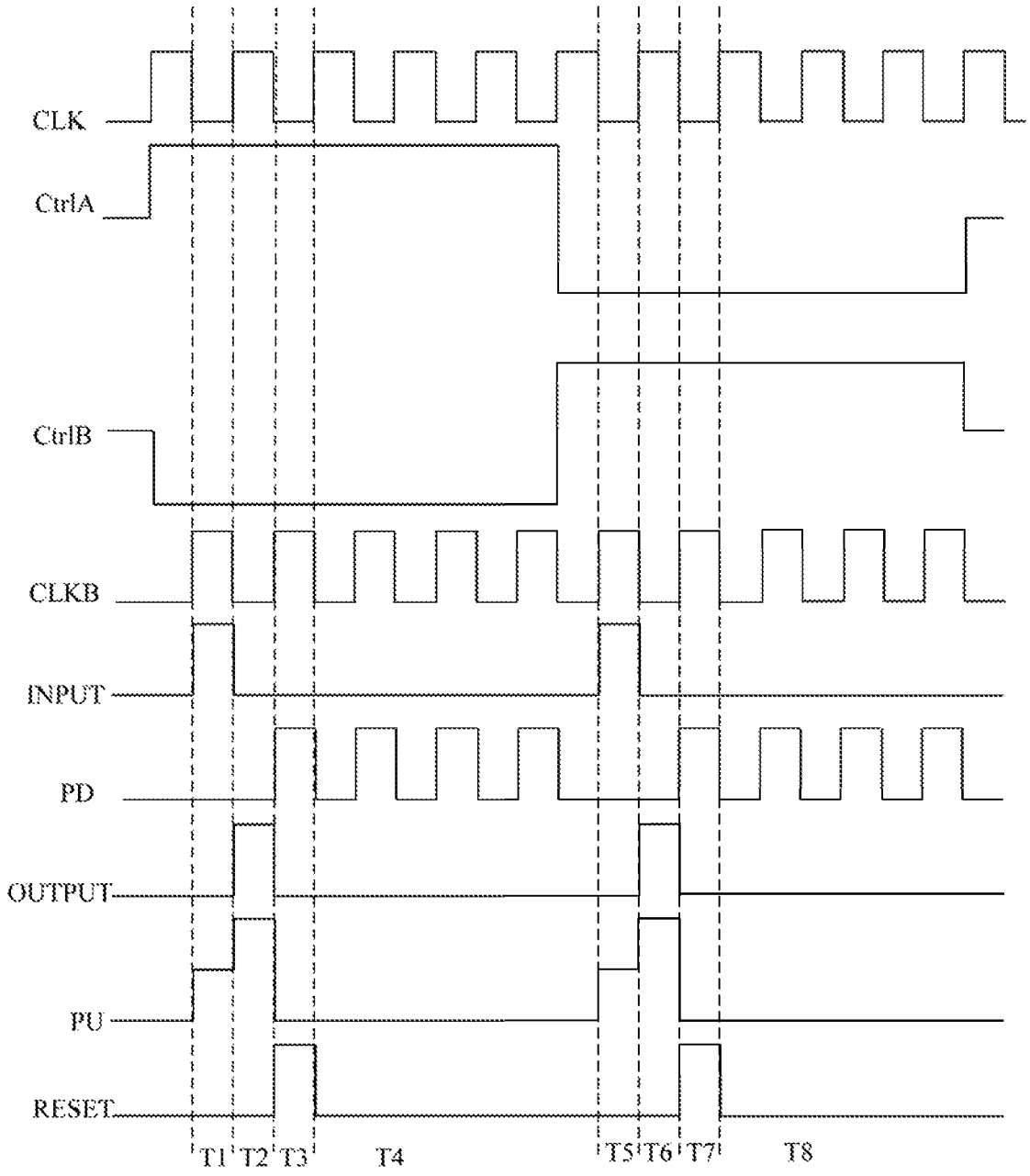
FIG. 4 shows a timing diagram of a gate driving circuit according to an embodiment of the present disclosure.

FIG. 4 shows a timing diagram of a gate driving circuit according to an embodiment of the present disclosure.

The timing diagram shown in FIG. 4 is suitable for line scanning of two frames of images. In the first frame period, the first control signal terminal CtrlA is inputted with a high level, and the second control signal terminal CtrlB is inputted with a low level.

At a first stage T1 of the first frame period, an input signal terminal INPUT is inputted with a high level, so that the level of the pull-up node PU is pulled up under control of the input subcircuit 1. At a second stage T2 of the first frame period, a first clock signal terminal CLK is inputted with a high level, so that the first pull-up subcircuit 2 outputs a high level to the output terminal OUTPUT under control of the first control signal. At a third stage T3 of the first frame period, the reset signal terminal RESET is applied with a high level, the first pull-down subcircuit 4 pulls down the level of the output terminal OUTPUT under control of the first control signal. The reset subcircuit 6 pulls down the level of the pull-up node PU under control of the reset signal.

In the second frame period, the first control signal terminal CtrlA is inputted with a low level, and the second control signal terminal CtrlB is inputted with a high level.

At a first stage T5 of the second frame period, the input signal terminal INPUT is applied with a high level, so that the input subcircuit t pulls up the level of the pull-up node PU under control of an input signal. At a second stage T6 of the second frame period, the first clock signal terminal CLK is inputted with a high level, so that the second pull-up subcircuit 3 outputs a high level to the output terminal OUTPUT under control of the second control signal. At a third stage 7 of the second frame period, the reset signal terminal RESET is inputted with a high level, so that the second pull-down subcircuit 5 pulls down the level of the output terminal OUTPUT under control of the second control signal. Meanwhile, the reset subcircuit 6 pulls down the level of the pull-up node PU under control of the reset signal.

Therefore, the first pull-up subcircuit 2 and the first pull-down subcircuit 4 operate in the first frame period. The second pull-up subcircuit 3 and the second pull-down subcircuit 5 operate in the second frame period. As a result, the time when the signal of the pull-up node PU is applied to the first pull-up subcircuit 2 and the second pull-up subcircuit 3 respectively is reduced to half of the original time. Furthermore, the time when the reset signal is applied to the first pull-down subcircuit 4 and the second pull-down subcircuit 5 respectively is reduced to half of the original time.

Figure 5:
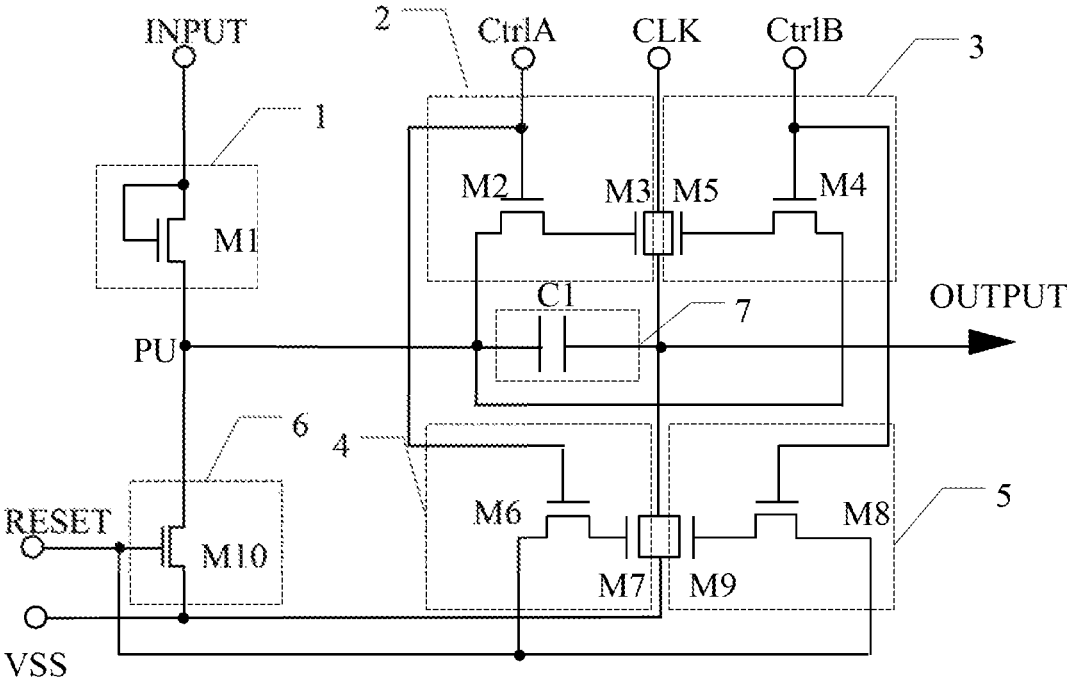
FIG. 5 shows a circuit diagram of a gate driving circuit according to an embodiment of the present disclosure.

FIG. 5 shows a circuit diagram of a gate driving circuit according to an embodiment of the present disclosure.

In the gate driving circuit, the input subcircuit 1 includes a first transistor M1. A gate electrode of the first transistor M1 and a first electrode thereof are electrically connected with the input signal terminal INPUT. A second electrode of the first transistor M1 is electrically connected with the pull-up node PU.

The first pull-up subcircuit 2 includes a second transistor M2 and a third transistor M3. A gate electrode of the second transistor M2 is electrically connected with the first control signal terminal CtrlA. A first electrode of the second transistor M2 is electrically connected with the pull-up node PU. A second electrode of the second transistor M2 is electrically connected with a gate electrode of the third transistor M3. A first electrode of the third transistor M3 is electrically connected with the first clock signal terminal CLK. A second electrode of the third transistor M3 is electrically connected with the output terminal OUTPUT.

The second pull-up subcircuit 3 includes a fourth transistor M4 and a fifth transistor M5. A gate electrode of the fourth transistor M4 is electrically connected with the second control signal terminal CtrlB. A first electrode of the fourth transistor M4 is electrically connected with the pull-up node PU. A second electrode of the fourth transistor M4 is electrically connected with a gate electrode of the fifth transistor M5. A first electrode of the fifth transistor M5 is electrically connected with the first clock signal terminal CLK. A second electrode of the fifth transistor M5 is electrically connected with the output terminal OUTPUT.

The first pull-down subcircuit 4 includes a sixth transistor M6 and a seventh transistor M7. A gate electrode of the sixth transistor M6 is electrically connected with the first control signal terminal CtrlA. A first electrode of the sixth transistor M6 is electrically connected with the reset signal terminal RESET. A second electrode of the sixth transistor M6 is electrically connected with a gate electrode of the seventh transistor M7. A first electrode of the seventh transistor M7 is electrically connected with the output terminal OUTPUT. A second electrode of the seventh transistor M7 is electrically connected with the first level terminal VSS.

The second pull-down subcircuit 5 includes an eighth transistor M8 and a ninth transistor M9. A gate electrode of the eighth transistor M8 is electrically connected with the second control signal terminal CtrlB. A first electrode of the eighth transistor M8 is electrically connected with the reset signal terminal RESET. A second electrode of the eighth transistor M8 is electrically connected with a gate electrode of the ninth transistor M9. A first electrode of the ninth transistor M9 is electrically connected with the output terminal OUTPUT. A second electrode of the ninth transistor M9 is electrically connected with the first level terminal VSS.

The reset subcircuit 6 includes a tenth transistor M10. A gate electrode of the tenth transistor M10 is electrically connected with a reset signal terminal RESET. A first electrode of the tenth transistor M10 is electrically connected with the pull-up node PU. A second electrode of the tenth transistor M10 is electrically connected with the first level terminal VSS.

The storage subcircuit 7 includes a storage capacitor CL. A first terminal of the storage capacitor C1 is electrically connected with the pull-up node PU, and a second terminal of the storage capacitor C1 is electrically connected with the output terminal OUTPUT.

The operating process of the gate driving subcircuit shown in FIG. 5 is described below in combination with the timing diagram shown in FIG. 4.

In the first frame period, a first control signal inputted correspondingly to the first control signal terminal CtrlA is at a high level. A second control signal inputted correspondingly to the input second control signal terminal CtrlB is at a low level. As such, the second transistor M2 and the sixth transistor M6 remain at an ON state, and the fourth transistor M4, the fifth transistor M5, the eighth transistor M8, and the ninth transistor M9 remain at an OFF state.

At the first stage T1 of the first frame period, the input signal terminal INPUT is inputted with a high level, the first clock signal terminal CLK is inputted with a low level, and the reset signal terminal RESET is inputted with a low level. Under control of the input signal inputted correspondingly to the input signal terminal INPUT, the first transistor M1 is turned on and the signal level of the pull-up node PU is pulled up. Meanwhile, the first transistor M1 charges the storage capacitor C1. At this moment, because the first control signal inputted correspondingly to the first control signal terminal CtrlA is at a high level, the second transistor M2 is turned on. Because the pull-up node PU is at a high level, the third transistor M3 is also turned on correspondingly. However, because the first clock signal terminal CLK is inputted with a low level, the output terminal OUTPUT is at a low level.

At the second stage T2 of the first frame period, the input signal terminal INPUT is inputted with a low level; the first clock signal terminal CLK is inputted with a high level; the reset signal terminal RESET is inputted with a low level. As such, the first transistor M1 is turned off. Due to the bootstrap effect of the storage capacitor C1, the level of signal of the pull-up node PU is further pulled up. In addition, under control of the first control signal inputted correspondingly to the first control signal input terminal CtrlA, the second transistor M2 is turned on so that the third transistor M3 is also turned on. Meanwhile, since the first clock signal terminal CLK is inputted with a high level, the output terminal OUTPUT outputs a high level. Therefore, the corresponding thin film transistors of the gate line electrically connected with the gate driving circuit are turned on.

At the third stage T3 of the first frame period, the input signal terminal INPUT is inputted with a low level; the first clock signal terminal CLK is inputted with a low level; and the reset signal terminal RESET is inputted with a high level. The sixth transistor M6 is turned on under control of the first control signal inputted correspondingly to the first control signal terminal CtrlA. Meanwhile, since the reset signal terminal RESET is inputted with a high level, the seventh transistor M7 is also turned on, and under an action of the first level terminal VSS, the level of the output terminal OUTPUT is pulled down. Meanwhile, the tenth transistor M10 is turned on, and under a control of the first level terminal VSS, the level of the pull-up node PU is pulled down.

In the second frame period, the first control signal inputted correspondingly to the first control signal terminal CtrlA is at a low level and the second control signal inputted correspondingly to the second control signal terminal CtrlB is at a high level. As such, the fourth transistor M4 and the eighth transistor M8 remain at an ON state, and the second transistor M2, the third transistor M3, the sixth transistor M6, and the seventh transistor M7 remain at an OFF state.

At the first stage T5 of the second frame period, the input signal terminal INPUT is inputted with a high level; the first clock signal terminal CLK is inputted with a low level; and the reset signal terminal RESET is inputted with a low level. As such, under control of the input signal inputted correspondingly to the signal terminal INPUT, the first transistor M1 is turned on, and the level of the pull-up node PU is pulled up. Meanwhile, the first transistor M1 charges the storage capacitor. At the same time, since the second control signal inputted correspondingly to the second control signal terminal CtrlB is at a high level, the fourth transistor M4 is turned on. In addition, since the pull-up node PU is at a high level, the fifth transistor M5 is also turned on. However, since the first clock signal terminal CLK is inputted with a low level, the output terminal OUTPUT is at a low level.

At the second stage T6 of the second frame period, the input signal terminal INPUT is inputted with a low level; the first clock signal terminal CLK is inputted with a high level; the reset signal terminal RESET is inputted with a low level. As such, the first transistor M1 is turned off. In addition, due to the bootstrap effect of the storage capacitor C1, the level of the pull-up node PU is further pulled up. Under control of the second control signal inputted correspondingly to the second control signal terminal CtrlB, the fourth transistor M4 is turned on, so that the fifth transistor M5 is also turned on. In addition, since the first clock signal terminal CLK is inputted with a high level, the output terminal OUTPUT outputs a high level, so that the corresponding thin film transistors of the gate line electrically connected with the gate driving circuit are turned on.

At the third stage T7 of the second frame period, the input signal terminal INPUT is inputted with a low level; the first clock signal terminal CLK is inputted with a low level; and the reset signal terminal RESET is inputted with a high level. As such, the eighth transistor M8 is turned on under control of the second control signal inputted correspondingly to the second control signal terminal CtrlB. Since the reset signal terminal RESET is inputted with a high level, the ninth transistor M9 is also turned on. Thus, under action of the first level terminal VSS, the level of the output terminal OUTPUT is pulled down. Meanwhile, the tenth transistor M10 is turned on, so that under the effect of the first level terminal VSS, the level of the pull-up node PU is pulled down.

In one embodiment, an output terminal OUTPUT of the gate driving circuit of the (N−1)-th row is electrically connected with an input signal terminal INPUT of the gate driving circuit of the N-th row. An output terminal OUTPUT of the gate driving circuit of the N-th row is electrically connected with a reset signal terminal RESET of the gate driving circuit of the (N−1)-th row. Wherein, N is a positive integer greater than 1. As such, a signal of the output terminal OUTPUT of the gate driving circuit of the (N−1)-th row serves as an input signal of the gate driving circuit of the N-th row. A signal of the output terminal OUTPUT of the gate driving circuit of the N-th row serves as a reset signal of the gate driving circuit of the N-th row.

The first transistor M1, the second transistor M2, the third transistor M3, the fourth transistor M4, the fifth transistor M5, the sixth transistor M6, the seventh transistor M7, the eighth transistor M8, the ninth transistor M9 and the tenth transistor M10 are all N-type transistors. When the gate electrode is at a high level, these transistors are turned on. When the gate electrode is at a low level, these transistors are turned off. In order to distinguish the two electrodes besides the gate electrode of the transistors, the drain electrode is called as a first electrode, and the source electrode is called as a second electrode. The first level signal inputted to the first level terminal VSS is at a low level.

In the embodiment of the present disclosure, the first control signal inputted to the first control signal terminal controls the first pull-up subcircuit and the first pull-down subcircuit to operate. The second control signal inputted to the second control signal terminal controls the second pull-up subcircuit and the second pull-down subcircuit to operate. As such, the first pull-up subcircuit and the second pull-up subcircuit operate alternately by controlling the level of the first control signal and that of the second control signal. Meanwhile, the first pull-down subcircuit and the second pull-down subcircuit operate alternately as well. As such, the time when each of the pull-up subcircuits is provided with the signal of the pull-up node is reduced. Also, the time when each of the pull-down subcircuits is provided with the reset signal is also reduced. As a result, threshold voltage drift of the TFT is effectively suppressed, thereby realizing stability of electrical characteristics of the TFT. The impact by the electrical characteristics of the TFT on the output of the output terminal is reduced, and occurrence rate of various poor displays due to the TFT characteristics is reduced.

Figure 6:
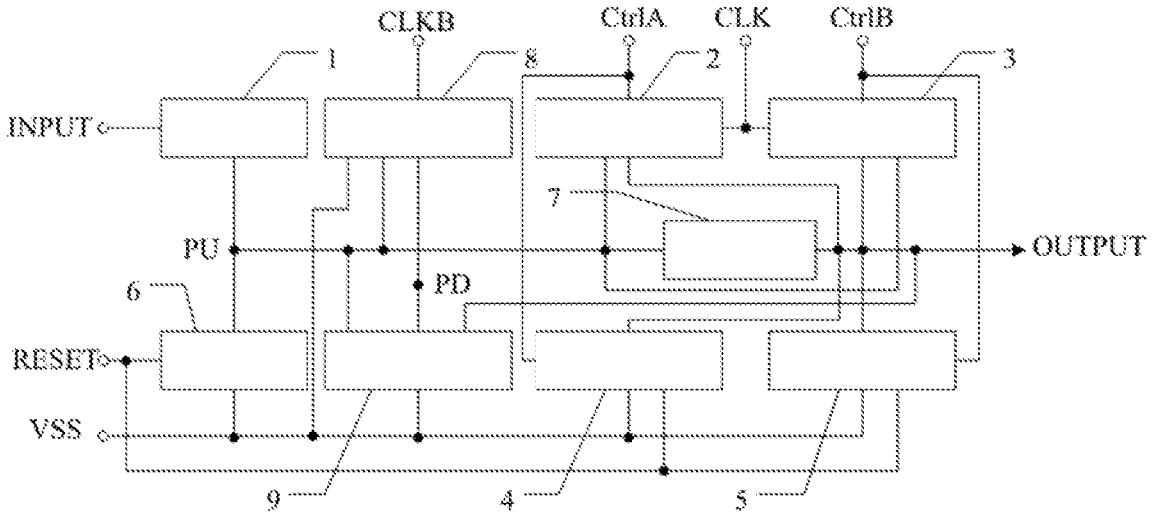
FIG. 6 shows a schematic diagram of a gate driving circuit according to an embodiment of the present disclosure.

FIG. 6 shows a schematic diagram of a gate driving circuit according to an embodiment of the present disclosure.

On the basis of FIG. 3, the gate driving circuit further includes a pull-down control subcircuit 8 and a third pull-down subcircuit 9.

The pull-down control subcircuit 8 is respectively electrically connected with a second clock signal terminal CLKB, a pull-down node PD, a pull-up node PU and a first level terminal VSS. It is used for pulling up the level of the pull-down node PD under control of the second clock signal. The second clock signal and the first clock signal inputted to the first clock signal terminal CLK are signals of the same-frequency and with reverse-phase.

The third pull-down subcircuit 9 is respectively electrically connected with the pull-down node PD, the first level terminal VSS, the pull-up node PU and the output terminal OUTPUT. It is used for pulling down the levels of the pull-down node PU and the output terminal OUTPUT under control of the pull-down node PD.

By providing the pull-down control subcircuit 8 and the third pull-down subcircuit 9 in the gate driving circuit, discharge capacity of the pull-up node PU and the output terminal OUTPUT is enhanced, so that the pull-up node PU and the output terminal OUTPUT are continuously pulled down to a low level, thereby ensuring stability of the signals of the pull-up node PU and the output terminal OUTPUT.

The pull-down control subcircuit 8 and the third pull-down subcircuit 9 operate mainly at the third stage T3 and the fourth stage T4 of the first frame period, and at the third stage T7 and the fourth stage T8 of the second frame period.

At the third stage T3 of the first frame period and the third stage T7 of the second frame period, the second clock signal CLKB is provided with a high level. Ander control of the second clock signal CLKB, the pull-down control subcircuit 8 pulls up the level of the pull-down node PD. Also, under control of the pull-down node PD, the third pull-down subcircuit 9 pulls down the levels of the pull-up node PU and the output terminal OUTPUT.

At the fourth stage T4 of the first frame period and the fourth stage T8 of the second frame period, under control of the second clock signal CLKB, the pull-down control subcircuit 8 controls the level of the pull-down node PD, and accordingly further control the third pull-down subcircuit 9 to pull down the levels of the pull-up node PU and the output terminal OUTPUT.

As shown in FIG. 4 and FIG. 6, at the third stage T3 of the first frame period and the third stage T7 of the second frame period, the second clock signal terminal CLKB is inputted with a high level. Under control of the second clock signal inputted to the second clock signal terminal CLKB, the pull-down control subcircuit 8 is turned on so that the level of the signal of the pull-down node PD is pulled up. Under control of the pull-down node PD, the third pull-down subcircuit 9 is turned on so that the levels of the signals of the pull-up node PU and the output terminal OUTPUT are pulled down.

At the fourth stage T4 of first frame period and the fourth stage T8 of the second frame period, the level of the pull-down node PD is controlled by the second clock signal CLKB. When the second clock signal inputted to the second clock signal terminal CLKB is at a high level, the pull-down control subcircuit 8 is turned on, so that the level of the pull-down node PD is pulled up. Under control of the pull-down node PD, the third pull-down subcircuit 9 is turned on so that the levels of the pull-up node PU and the output terminal OUTPUT are pulled down. When the second clock signal inputted to the second clock signal terminal CLKB is at a low level, the pull-down control subcircuit 8 is turned off and the pull-down node PD is at a low level. At this moment, the third pull-down subcircuit 9 is also turned off.

Figure 7:
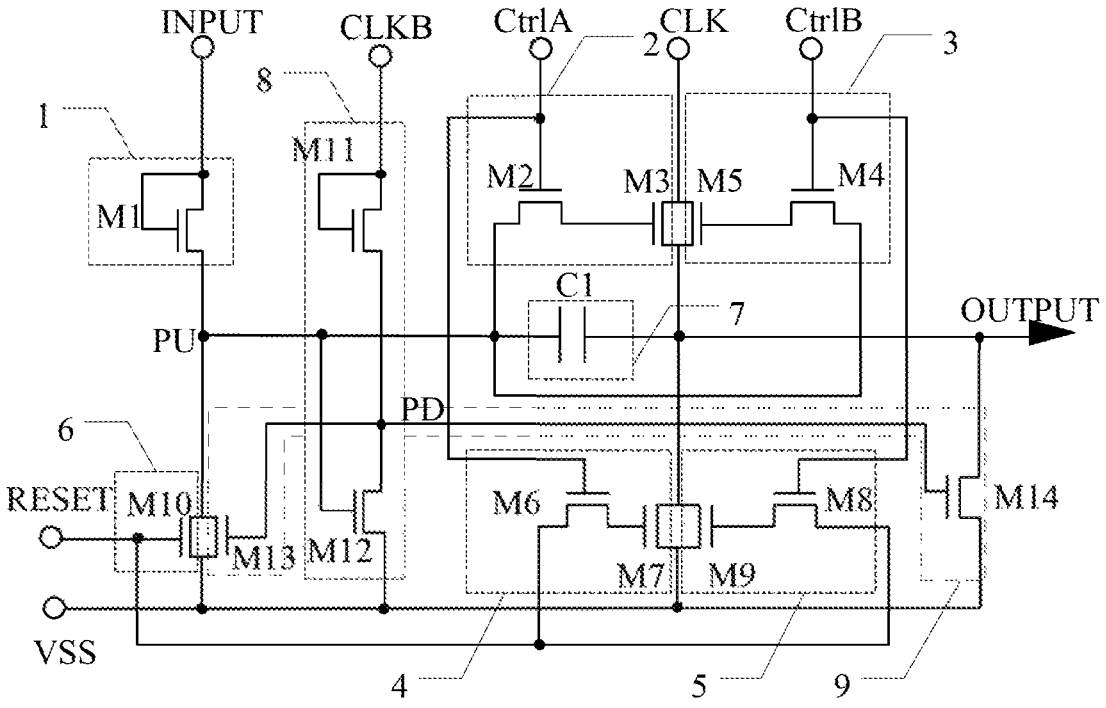
FIG. 7 shows a circuit diagram of a gate driving circuit according to an embodiment of the present disclosure.

FIG. 7 shows a circuit diagram of a gate driving circuit according to an embodiment of the present disclosure.

In the gate driving circuit, the pull-down control subcircuit 8 includes an eleventh transistor M11 and a twelfth transistor M12. A gate electrode and a first electrode of the eleventh transistor M11 are electrically connected with the second clock signal terminal CLKB. A second electrode of the eleventh transistor M11 is electrically connected with the pull-down node PD. A gate electrode of the twelfth transistor M12 is electrically connected with the pull-up node PU. A first electrode of the twelfth transistor M12 is electrically connected with the pull-down node PD. A second electrode of the twelfth transistor M12 is electrically connected with the first level terminal VSS.

The third pull-down subcircuit 9 includes a thirteenth transistor M13 and a fourteenth transistor M14. A gate electrode of the thirteenth transistor M13 is electrically connected with the pull-down node PD. A first electrode of the thirteenth transistor M13 is electrically connected with the pull-up node PU. A second electrode of the thirteenth transistor M13 is electrically connected with a first level terminal VSS. A gate electrode of the fourteenth transistor M14 is electrically connected with the pull-down node PD. A first electrode of the fourteenth transistor M14 is electrically connected with the output terminal OUTPUT. A second electrode of the fourteenth transistor M14 is electrically connected with the first level terminal VSS.

The operating process of the gate driving circuit shown in FIG. 7 is described in the following in combination with the timing diagram shown in FIG. 4.

The second clock signal inputted to the second clock signal terminal CLKB and the first clock signal inputted to the first clock signal terminal CLK are signals of the same frequency with inverse phases. When the second clock signal is at a high level, the first clock signal is at a low level. When the second clock signal is at low level, the first clock signal is at a high level.

In the first frame period, when the first control signal correspondingly inputted to the first control signal terminal CtrlA is at a high level, the second control signal correspondingly inputted to the second control signal terminal CtrlB is at a low level.

At the first stage T1 of the first frame period, the input signal terminal INPUT is inputted with a high level; the first clock signal terminal CLK is inputted with a low level; the reset signal terminal RESET is inputted with a low level; and the second clock signal terminal CLKB is inputted with a high level. As such, the first transistor M1 is turned on so that the level of the pull-up node PU is pulled up. Meanwhile, the first transistor M1 charges the storage capacitor CL. At the same time, since the second clock signal inputted to the second clock signal terminal CLKB is at a high level, the eleventh transistor M11 is turned on so that the level of the pull-down node PD is pulled up. At the same time, since the level of the pull-up node PU is pulled up, the twelfth transistor M12 is turned on so that the level of the pull-down node PD is pulled down.

At the second stage T2 of the first frame period, the input signal terminal INPUT is inputted with a low level; the first clock signal terminal CLK is inputted with a high level, the reset signal terminal RESET is inputted with a low level, and the second clock signal terminal CLKB is inputted with a low level. As such, the first transistor M1 is turned off. Due to the bootstrap effect of the storage capacitor C1, the level of the pull-up node PU is further pulled up. In addition, the second transistor M2 is turned on so that the third transistor M3 is also turned on. Since the first clock signal terminal CLK is inputted with a high level, the output terminal OUTPUT outputs a high level. Therefore, corresponding thin film transistors of the gate line electrically connected with the gate driving circuit are turned on. At this moment, the eleventh transistor M11 is turned off. The twelfth transistor M12 is turned on, and the pull-down node PD is kept at a low level.

At the third stage T3 of the first frame period, the first clock signal terminal CLK is inputted with a low level; the reset signal terminal RESET is inputted with a high level; and the second clock signal terminal CLKB is inputted with a high level. The sixth transistor M6 is turned on. At the same time, since the reset signal terminal RESET is inputted with a high level, the seventh transistor M7 is also turned on so that under action of the first level terminal VSS, the signal level of the output terminal OUTPUT is pulled down. At the same time, the tenth transistor M10 is turned on so that under action of the first level terminal VSS, the level of the pull-up node PU is pulled down. Also, the eleventh transistor M11 is turned on. The twelfth transistor M12 is turned off, and the level of the pull-down node PD is pulled up. As such, the thirteenth transistor M13 and the fourteenth transistor M14 are turned on. Moreover, under action of the first level terminal VSS, the level of the pull-up node PU and that of the output terminal OUTPUT are pulled down respectively.

At the fourth stage T4 of the first frame period, the input signal terminal INPUT is inputted with a low level; the reset signal terminal RESET is inputted with a low level. The signal level of the pull-down node PD is controlled by the second clock signal. When the second clock signal inputted to the second clock signal terminal CLKB is at a high level, the eleventh transistor M11 is turned on so that the pull-down node PD is at a high level. When the second clock signal inputted to the second clock signal terminal CLKB is at a low level, the eleventh transistor M11 is turned off so that the pull-down node PD is at a low level. When the pull-down node PD is at a high level, the thirteenth transistor M13 and the fourteenth transistor M14 are turned on which continuously pulling down the level of the pull-up node PU and that of the output terminal OUTPUT. Therefore, the stability of the signal of the pull-up node PU and the signal of the output terminal OUTPUT is ensured.

In the second frame period, the first control signal correspondingly inputted to the first control signal terminal CtrlA is at a low level. The second control signal correspondingly inputted to second control signal terminal CtrlB is at a high level.

At the first stage T5 of the second frame period, the input signal terminal INPUT is inputted with a high level; the first clock signal terminal CLK is inputted with a low level; the reset signal terminal RESET is inputted with a low level; and the second clock signal terminal CLKB is inputted with a high level. As such, the first transistor M1 is turned on so that the level of the pull-up node PU is pulled up. Meanwhile, the first transistor M1 charges the storage capacitor C1. At the same time, since the second clock signal inputted to the second clock signal terminal CLKB is at a high level, the eleventh transistor M11 is turned on so that the level of the pull-down node PD is pulled up. Meanwhile, since the level of the pull-up node PU is pulled up, the twelfth transistor M12 is turned on so that the level of the pull-down node PD is pulled down.

At the second period T6 of the second frame period, the input signal terminal INPUT is inputted with a low level; the first clock signal terminal CLK is inputted with a high level; the reset signal terminal RESET is inputted with a low level; and the second clock signal terminal CLKB is inputted with a low level. As such, the first transistor M1 is turned off. Also, due to the bootstrap effect of the storage capacitor C1, the level of the pull-up node PU is further pulled up. The fourth transistor M4 is turned on so that the fifth transistor M5 is also turned on as well. Since the first clock signal terminal CLK is inputted with a high level, the output terminal OUTPUT outputs a high level. As a result, the corresponding thin film transistors of the gate line electrically connected with the gate driving circuit are turned on.

At the third stage T7 of the second frame period, the input signal terminal INPUT is inputted with a low level; the first clock signal terminal CLK is inputted with a low level; the reset signal terminal RESET is inputted with a high level; and the second clock signal terminal CLKB is inputted with a high level. The eighth transistor M8 is turned on. Since the reset signal terminal RESET is inputted with a high level, the ninth transistor M9 is also turned on. Under action of the first level terminal VSS, the level of the output terminal OUTPUT is pulled down. Meanwhile, the tenth transistor M10 is turned on so that the level of the pull-up node PU is pulled down under action of the first level terminal VSS. At the same time, the eleventh transistor M11 is turned on, and the twelfth transistor M12 is turned off. As such, the level of the pull-down node PD is pulled up so that the thirteenth transistor M13 and the fourteenth transistor M14 are turned on. Under action of the first level terminal VSS, the level of the pull-up node PU and the level of the output terminal OUTPUT are pulled down respectively.

At the fourth stage T8 of the second frame period, the input signal terminal INPUT is inputted with a low level and the reset signal terminal RESET is inputted with a low level. The level of the pull-down node PD is controlled by the second clock signal. When the second clock signal inputted to the second clock signal terminal CLKB is at a high level, the eleventh transistor M11 is turned on so that the pull-down node PD is at a high level. When the second clock signal inputted to the second clock signal terminal CLKB is at a low level, the eleventh transistor M11 is turned off so that the pull-down node PD is at a low level. When the pull-down node PD is at a high level, the thirteenth transistor M13 and the fourteenth transistor M14 are turned on to further pull down the signal level of the pull-up node PU and that of the output terminal OUTPUT respectively. Therefore, the stability of the signal of the pull-up section PU and the signal of the output terminal OUTPUT is ensured.

In one embodiment, the eleventh transistor M11, the twelfth transistor M12, the thirteenth transistor M13 and the fourteenth transistor M14 are also N-type transistors. The transistors are turned on when the gate electrodes thereof are at a high level respectively. The transistors are turned off when the gate electrodes are at a low level respectively. A drain electrode of each of the transistors is referred to as a first electrode, and a source electrode thereof is referred to as a second electrode.

In the embodiment of the present disclosure, and the first pull-up subcircuit and the first pull-down subcircuit are controlled to operate through a first control signal inputted to the first control signal terminal, and the second pull-up subcircuit and the second pull-down subcircuit are controlled to operate through a second control signal inputted to the second control signal terminal. As such, the first pull-up subcircuit and the second pull-up subcircuit operate alternately by controlling the level of the first control signal and the level of the second control signal. At the same time, the first pull-down subcircuit and the second pull-down subcircuit operate alternately. As a result, the time when each pull-up subcircuits is controlled by the signal of the pull-up node is reduced, and the time when each of the pull-down subcircuits is controlled by the reset signal is also reduced. Therefore, the threshold voltage drift of the TFT is effectively suppressed, thereby realizing the stability of electrical characteristics of the TFT. The impact by the electrical characteristics of the TFT on the output of the output terminal is reduced, and the occurrence rate of various poor displays due to the TFT characteristics is reduced. Meanwhile, the pull-down control subcircuit and the third pull-down continuously pull down the pull-up node and the output terminal to a low level, thereby ensuring the stability of the signal of the pull-up node and that of the output terminal.

A display apparatus is also provided according to one embodiment of the present disclosure. The display apparatus includes the gate driving circuit according to one embodiment of the present disclosure.

For the above embodiments, for simplicity of description, all the actions are expressed as a series of combinations of actions. However, the method is not limited to the sequence of the actions as described. According to the disclosure, some steps can be carried out in other orders or simultaneously. Secondly, in some embodiments described in the specification, some actions or subcircuits involved in the disclosure are not necessarily required.

Various embodiments in the specification are described in a progressive manner. The emphasis is placed upon clearly illustrating the principles of the present disclosure. Some parts of the embodiments which are similar to each other can reference each other.

Moreover, the terms "comprising," "comprises," or any other variants thereof are intended to encompass a non-exclusive inclusion, so that the process and the method include a series of elements. The commodity or the equipment may include not only those elements, but also other elements not explicitly listed, or further includes the inherent elements of the process, the method, the commodity or the equipment. Unless further defined, the phrase "include a/an" does not exclude other elements in the method, the commodity or the equipment.

The gate driving circuit, the driving method and the display apparatus are introduced in detail in the above disclosure. The principle and the embodiment of the disclosure are set forth in the specification. The description of the embodiments of the present disclosure is only used to help understand the method of the present disclosure and the core idea thereof. Meanwhile, for a person of ordinary skill in the art, according to the idea of the disclosure, the specific embodiment and the application range may be changed. In conclusion, the content of the specification should not be construed as a limitation of the present disclosure.

What is claimed is:

1. A gate driving circuit, comprising a first pull-up subcircuit;

a second pull-up subcircuit;

a first pull-down subcircuit;

a second pull-down subcircuit;

wherein the first pull-up subcircuit is respectively electrically connected with a first control signal terminal, a pull-up node, a first clock signal terminal, and an output terminal, and the first pull-up subcircuit is configured to output a high level to the output terminal under control of a first control signal of the first control signal terminal;

the second pull-up subcircuit is respectively electrically connected with a second control signal terminal, the pull-up node, the first clock signal terminal, and the second pull-up subcircuit is configured to output a high level to the output terminal under control of a second control signal of the second control signal terminal;

the first pull-down subcircuit is electrically connected with the first control signal terminal, a reset signal terminal, a first level terminal and the output terminal, and the first pull-down subcircuit is configured to pull down a level of the output terminal under control of the first control signal; and the second pull-down subcircuit is respectively electrically connected with the second control signal terminal, the reset signal terminal, the first level terminal, and the output terminal, and the second pull-down subcircuit is configured to pull down the level of the output terminal under control of the second control signal.

2. The gate driving circuit according to claim 1, further comprising:

an input subcircuit;

a reset subcircuit; and a storage subcircuit;

wherein the input subcircuit is respectively electrically connected with an input signal terminal and the pull-up node;

the reset subcircuit is electrically connected with the reset signal terminal, the first level terminal, and the pull-up node respectively, and the reset subcircuit is configured to pull down a level of the pull-up node under control of the reset signal; and the storage subcircuit is respectively electrically connected with the pull-up node and the output terminal.

3. The gate driving circuit according to claim 1 wherein the first control signal and the second control signal are signals of the same-frequency with inverse phases.

4. The gate driving circuit according to claim 2, wherein the input subcircuit comprises a first transistor;

a gate electrode and a first electrode of the first transistor are electrically connected with the input signal terminal, and a second electrode of the first transistor is electrically connected with the pull-up node.

5. The gate driving circuit according to claim 1, wherein the first pull-up subcircuit comprises a second transistor and a third transistor;

a gate electrode of the second transistor is electrically connected with the first control signal terminal, a first electrode of the second transistor is electrically connected with the pull-up node, and a second electrode of the second transistor is electrically connected with a gate electrode of the third transistor; and a first electrode of the third transistor is electrically connected with the first clock signal terminal, and a second electrode of the third transistor is electrically connected with the output terminal.

6. The gate driving circuit according to claim 1, wherein the second pull-up subcircuit comprises a fourth transistor and a fifth transistor;

a gate electrode of the fourth transistor is electrically connected with the second control signal terminal, a first electrode of the fourth transistor is electrically connected with the pull-up node, and a second electrode of the fourth transistor is electrically connected with a gate electrode of the fifth transistor; and a first electrode of the fifth transistor is electrically connected with the first clock signal terminal and a second electrode of the fifth transistor is electrically connected with the output terminal.

7. The gate driving circuit according to claim 1, wherein the first pull-down subcircuit comprises a sixth transistor and a seventh transistor;

a gate electrode of the sixth transistor is electrically connected with the first control signal terminal, a first electrode of the sixth transistor is electrically connected with the reset signal terminal, and a second electrode of the sixth transistor is electrically connected with the gate electrode of the seventh transistor; and a first electrode of the seventh transistor is electrically connected with the output terminal and a second electrode of the seventh transistor is electrically connected with the first level terminal.

8. The gate driving circuit according to claim 1, wherein the second pull-down subcircuit comprises an eighth transistor and a ninth transistor;

a gate electrode of the eighth transistor is electrically connected with the second control signal terminal, a first electrode of the eighth transistor is electrically connected with the reset signal terminal, and a second electrode of the eighth transistor is electrically connected with the gate electrode of the ninth transistor; and a first electrode of the ninth transistor is electrically connected with the output terminal, and a second electrode of the ninth transistor is electrically connected with the first level terminal.

9. The gate driving circuit according to claim 2, wherein the reset subcircuit comprises a tenth transistor;

a gate electrode of the tenth transistor is electrically connected with the reset signal terminal, a first electrode of the tenth transistor is electrically connected with the pull-up node, and a second electrode of the tenth transistor is electrically connected with the first level terminal.

10. The gate driving circuit according to claim 2, wherein the storage subcircuit comprises a storage capacitor;

a first terminal of the storage capacitor is electrically connected with the pull-up node, and a second terminal of the storage capacitor is electrically connected with the output terminal.

11. The gate driving circuit according to claim 1, further comprises a pull-down control subcircuit and a third pull-down subcircuit;

the pull-down control subcircuit is respectively electrically connected with the second clock signal terminal and the pull-down node, the pull-up node, and the first level terminal, and the pull-down control subcircuit is configured to pull up the level of the pull-down node under control of the second clock signal; the second clock signal and the first clock signal inputted to the first clock signal terminal being signals of the same frequency with inverse phases; and the third pull-down subcircuit is electrically connected with the pull-down node, the first level terminal, the pull-up node, and the output terminal, and the third pull-down subcircuit is configured to pull down the levels of the pull-up node and the output terminal under control of the pull-down node.

12. The gate driving circuit according to claim 11, wherein the pull-down control subcircuit comprises an eleventh transistor and a twelfth transistor;

a gate electrode and a first electrode of the eleventh transistor are electrically connected with the second clock signal terminal, and a second electrode of the eleventh transistor is electrically connected with the pull-down node; and a gate electrode of the twelfth transistor is electrically connected with the pull-up node, a first electrode of the twelfth transistor is electrically connected with the pull-down node, and a second electrode of the twelfth transistor is electrically connected with the first level terminal.

13. The gate driving circuit according to claim 11, wherein the third pull-down subcircuit comprises a thirteenth transistor and a fourteenth transistor;

a gate electrode of the thirteenth transistor is electrically connected with the pull-down node, a first electrode of the thirteenth transistor is electrically connected with the pull-up node, and a second electrode of the thirteenth transistor is electrically connected with the first level terminal;

a gate electrode of the fourteenth transistor is electrically connected with the pull-down node, a first electrode of the fourteenth transistor is electrically connected with the output terminal, and a second electrode of the fourteenth transistor is electrically connected with the first level terminal.

14. A driving method of the gate driving circuit according to claim 1, the driving method comprises a first frame period and a second frame period, wherein in the first frame period, the first control signal terminal is inputted with a high level and the second control signal terminal is inputted with a low level; at a first stage of the first frame period, the input signal terminal is inputted with a high level so that the input subcircuit pulls up the level of the pull-up node under control of the input signal; at a second stage of the first frame period, the first clock signal terminal is inputted with a high level, the first pull-up subcircuit outputs a high level to the output terminal under control of the first control signal; at a third stage of the first frame period, the reset signal terminal is inputted with a high level, the first pull-down subcircuit pulls down the level of the output terminal under control of the first control signal; and the reset subcircuit pulls down the level of the pull-up node under control of the reset signal; and in the second frame period, the first control signal terminal is inputted with a low level, and the second control signal terminal is inputted with a high level; at a first stage of the second frame period, the input signal terminal is inputted with a high level, the input subcircuit pulls up the level of the pull-up node under control of the input signal; at a second stage of the second frame period, the first clock signal terminal is inputted with a high level, the second pull-up subcircuit outputs a high level to the output terminal under control of the second control signal;

at a third stage of the second frame period, the reset signal terminal is inputted with a high level, the second pull-down subcircuit pulls down the level of the output terminal under control of the second control signal, and the reset subcircuit pulls down the level of the pull-up node under control of the reset signal.

15. The driving method according to claim 14, further comprising:

at the third stage of the first frame period and the third stage of the second frame period, the second clock signal terminal is inputted with a high level, the pull-down control subcircuit pulls up the level of the pull-down node under control of the second clock signal, the third pull-down subcircuit pulls down the level of the pull-up node and the level of the output terminal under control of the pull-down node; and at a fourth stage of the first frame period and a fourth stage of the second frame period, the pull-down control subcircuit controls the level of the pull-down node under control of the second clock signal and controls the third pull-down subcircuit to pull down the levels of the pull-up node and the output terminal.

16. A display apparatus comprising the gate driving circuit according to claim 1.

* * * * *